US011802329B2

(12) United States Patent
Terasaki et al.

(10) Patent No.: US 11,802,329 B2
(45) Date of Patent: Oct. 31, 2023

(54) METHOD OF PRODUCING HOT-DIP METAL COATED STEEL STRIP AND CONTINUOUS HOT-DIP METAL COATING LINE

(71) Applicant: JFE STEEL CORPORATION, Tokyo (JP)

(72) Inventors: Yu Terasaki, Tokyo (JP); Hideyuki Takahashi, Tokyo (JP); Takumi Koyama, Tokyo (JP); Yoshihiko Kaku, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 17/265,205

(22) PCT Filed: Jul. 31, 2019

(86) PCT No.: PCT/JP2019/030071
§ 371 (c)(1),
(2) Date: Feb. 2, 2021

(87) PCT Pub. No.: WO2020/039869
PCT Pub. Date: Feb. 27, 2020

(65) Prior Publication Data

US 2021/0310109 A1 Oct. 7, 2021

(30) Foreign Application Priority Data

Aug. 22, 2018 (JP) ..... 2018-155714

(51) Int. Cl.
*C23C 2/20* (2006.01)
*C23C 2/00* (2006.01)
*C23C 2/06* (2006.01)

(52) U.S. Cl.
CPC ..... *C23C 2/20* (2013.01); *C23C 2/003* (2013.01); *C23C 2/06* (2013.01)

(58) Field of Classification Search
CPC ..... C23C 2/20; C23C 2/003; C23C 2/06
See application file for complete search history.

(56) References Cited

U.S. PATENT DOCUMENTS 7,361,385 B2 4/2008 Kabeya et al.
10,815,559 B2 10/2020 Yonekura et al.
(Continued)

FOREIGN PATENT DOCUMENTS

CN 1501985 A 6/2004
CN 107923025 A 4/2018
(Continued)

OTHER PUBLICATIONS

JP 2012021183 A English translation (Year: 2022).*
(Continued)

*Primary Examiner* — Hai Y Zhang
(74) *Attorney, Agent, or Firm* — KENJA IP LAW PC

(57) ABSTRACT

Provided is a method of producing a hot-dip metal coated steel strip with which a hot-dip metal coated steel strip of high quality can be produced by sufficiently suppressing edge overcoating. The method comprises spraying gas from a pair of gas wiping nozzles 20A and 20B onto a steel strip S while being pulled up from a molten metal bath 14, to adjust a coating weight of molten metal on both sides of the steel strip S, wherein a pair of baffle plates 40 and 42 are respectively placed outside of both transverse edges of the steel strip, and a height B of a lower end of each of the pair of baffle plates 40 and 42 with respect to a bath surface of the molten metal bath is set to +50 mm or less, where an upper side in a vertical direction is positive.

8 Claims, 9 Drawing Sheets

(56) References Cited

U.S. PATENT DOCUMENTS

| | | | |
|---|---|---|---|
| 11,104,983 | B2 | 8/2021 | Terasaki et al. |
| 2019/0300997 | A1 | 10/2019 | Terasaki et al. |

FOREIGN PATENT DOCUMENTS

| | | | | | |
|---|---|---|---|---|---|
| EP | 2594658 | A1 | | 5/2013 | |
| EP | 3205741 | A1 | * | 8/2017 | ..... C22C 18/04 |
| EP | 3287541 | B1 | | 7/2019 | |
| JP | H10237616 | A | * | 9/1998 | ..... C23C 2/20 |
| JP | H11279736 | A | * | 10/1999 | ..... C23C 2/16 |
| JP | 2004059943 | A | | 2/2004 | |
| JP | 2012021183 | A | * | 2/2012 | ..... C23C 2/003 |
| JP | 2012021183 | A | | 2/2012 | |
| JP | 2014181361 | A | | 9/2014 | |
| JP | 2016204694 | A | | 12/2016 | |
| JP | 2018009220 | A | | 1/2018 | |
| JP | 2018178154 | A | | 11/2018 | |
| WO | WO-2016056178 | A1 | * | 4/2016 | ..... C22C 18/04 |
| WO | 2018012132 | A1 | | 1/2018 | |

OTHER PUBLICATIONS

JP-2012021183-A English translation. (Year: 2023).*

Jun. 10, 2020, Office Action issued by the Taiwan Intellectual Property Office in the corresponding Taiwanese Patent Application No. 108129302 with English language Search Report.

Sep. 10, 2019, International Search Report issued in the International Patent Application No. PCT/JP2019/030071.

Jul. 1, 2022, Office Action issued by the Korean Intellectual Property Office in the corresponding Korean Patent Application No. 10-2021-7002651 with English language concise statement of relevance.

Aug. 16, 2022, Office Action issued by the China National Intellectual Property Administration in the corresponding Chinese Patent Application No. 201980049825.3 with English language search report.

* cited by examiner

METHOD OF PRODUCING HOT-DIP METAL COATED STEEL STRIP AND CONTINUOUS HOT-DIP METAL COATING LINE

TECHNICAL FIELD

The present disclosure relates to a method of producing a hot-dip metal coated steel strip and a continuous hot-dip metal coating line, and particularly relates to gas wiping for adjusting the coating weight of molten metal (hereafter also referred to as "coating weight") on the steel strip surface.

BACKGROUND

As illustrated in FIG. 10, in a continuous hot-dip metal coating line, a steel strip S annealed in a continuous annealing furnace with a reducing atmosphere passes through a snout 10, and is continuously introduced into a molten metal bath 14 in a coating tank 12. The steel strip S is then pulled upward from the molten metal bath 14 through a sink roll 16 and support rolls 18 in the molten metal bath 14, and adjusted to have a predetermined coating thickness by gas wiping nozzles 20A and 20B. After this, the steel strip S is cooled, and guided to subsequent steps. The gas wiping nozzles 20A and 20B face each other with the steel strip S therebetween, above the coating tank 12. The gas wiping nozzles 20A and 20B spray gas onto both sides of the steel strip S from their jet orifices. By this gas wiping, excess molten metal is wiped away to adjust the coating weight on the steel strip surface and also uniformize, in the sheet transverse (width) direction and the sheet longitudinal direction, the molten metal adhering to the steel strip surface.

The gas wiping nozzles 20A and 20B are each typically made wider than the steel strip width to accommodate various steel strip widths and also cope with, for example, a displacement of the steel strip in the transverse direction when pulling the steel strip up. The gas wiping nozzles 20A and 20B thus each extend outward beyond the transverse edges of the steel strip.

In such gas wiping, edge overcoating tends to occur. In detail, outside of both transverse edges of the steel strip, the gas that has blown out of the pair of gas wiping nozzles collides with each other and the gas flow becomes turbulent, which causes a decrease in wiping force in a region (edge portion) of the steel strip surface near each of the transverse edges and results in edge overcoating, i.e. the coating weight in the edge portion of the steel strip surface being relatively large. Particularly in the case of a high coating weight of 120 $g/m^2$ or more, edge overcoating is more noticeable. This is because, when the gas wiping nozzles are operated at a low wiping gas pressure to achieve a high coating weight, the wiping force in the edge portion of the steel strip surface decreases more. A coated steel sheet with such edge overcoating is cut before coiling. This significantly affects the yield rate of coated steel sheets.

As a method of suppressing the coating surface defect of edge overcoating, the following method is known: JP 2012-21183 A (PTL 1) describes a method whereby a pair of baffle plates are arranged outside of both transverse edges of a steel strip at a height at which a pair of gas wiping nozzles are placed, to prevent collision of gas sprayed from the pair of gas wiping nozzles. According to PTL 1, edge overcoating can be suppressed by this gas collision prevention.

CITATION LIST

Patent Literature

PTL 1: JP 2012-21183 A

SUMMARY

Technical Problem

However, our studies revealed that the method described in PTL 1 can suppress edge overcoating to some extent but its effect is insufficient.

It could therefore be helpful to provide a method of producing a hot-dip metal coated steel strip and a continuous hot-dip metal coating line that can produce a hot-dip metal coated steel strip of high quality by sufficiently suppressing edge overcoating.

Solution to Problem

As a result of intensive studies, we discovered the following: The method described in PTL 1 is based on the technical concept of simply placing the baffle plates at the height at which the pair of gas wiping nozzles facing each other are placed to prevent, outside of both transverse edges of the steel strip, direct collision of the gas from the pair of gas wiping nozzles. Accordingly, the distance from the lower end of each baffle plate 60 to the bath surface is relatively long, as illustrated in FIG. 8. However, when observing the edge portion of the steel sheet surface at a position lower than the wiping nozzles 20A and 20B, a phenomenon in which the molten metal remains and become massive in the edge portion lower than the lower end of the baffle plate 60 was seen. Such massive molten metal causes edge overcoating.

The mechanism of this phenomenon is considered as follows: The gas that has collided with both sides of the baffle plate 60 outside of each transverse edge of the steel strip S descends along the surface of the baffle plate 60 while having a component in a direction perpendicular to the surface of the baffle plate 60. Therefore, directly below the lower end of the baffle plate, the gas from both sides of the baffle plate 60 collides with each other to some extent, which causes turbulence. Due to this turbulence, the wiping force decreases in the edge portion lower than the lower end of the baffle plate. As illustrated in FIG. 8, the wiping involves not only wiping action in the site (stagnation point) where the gas collides with the steel strip S but also wiping action resulting from the collided gas flowing downward on the steel strip S to exert a shear force. In the edge portion lower than the lower end of the baffle plate, however, the wiping action by the shear force decreases due to the foregoing turbulence. In the case where such an edge portion in which the wiping force decreases is long in the vertical direction, top dross (a mass of zinc oxide floating on the bath surface) drawn up by the steel strip cannot be removed sufficiently, or pulled-up molten metal remains in the edge portion while being oxidized and becomes massive.

We conceived that shortening the distance from the lower end of the baffle plate to the bath surface in order to shorten the vertical length of the edge portion in which the wiping force decreases contributes to suppression of edge overcoating. As a result of studying the correlation between the distance from the lower end of the baffle plate to the bath surface and the occurrence of edge overcoating, we discovered that edge overcoating can be sufficiently suppressed by limiting the distance to 50 mm or less.

The present disclosure is based on these discoveries. We thus provide:

[1] A method of producing a hot-dip metal coated steel strip, the method comprising: continuously immersing a steel strip into a molten metal bath; and spraying, onto the steel strip while being pulled up from the molten metal bath, gas from respective slit-like gas jet orifices of a pair of gas wiping nozzles arranged so that the steel strip is situated therebetween, to adjust a coating weight of molten metal on both sides of the steel strip to thereby continuously produce a hot-dip metal coated steel strip, the gas jet orifices each being wider than the steel strip in a transverse direction of the steel strip, wherein a pair of baffle plates are respectively placed outside of both transverse edges of the steel strip in a state in which both sides of each of the pair of baffle plates partially face the respective gas jet orifices of the pair of gas wiping nozzles, and a height B of a lower end of each of the pair of baffle plates with respect to a bath surface of the molten metal bath is set to +50 mm or less, where an upper side in a vertical direction is positive.

[2] The method of producing a hot-dip metal coated steel strip according to [1], wherein the height B is set to −10 mm or more.

[3] The method of producing a hot-dip metal coated steel strip according to [1] or [2], wherein the pair of gas wiping nozzles are each placed to point downward with respect to a horizontal plane so that an angle θ between the gas jet orifice and the horizontal plane is 10° or more and 75° or less.

[4] The method of producing a hot-dip metal coated steel strip according to any one of [1] to [3], wherein a chemical composition of the molten metal contains (consists of) Al: 1.0 mass % to 10 mass %, Mg: 0.2 mass % to 1 mass %, and Ni: 0 mass % to 0.1 mass %, with a balance being Zn and inevitable impurities.

[5] A continuous hot-dip metal coating line, comprising: a coating tank configured to contain molten metal and form a molten metal bath; a pair of gas wiping nozzles arranged so that a steel strip being continuously pulled up from the molten metal bath is situated therebetween, having respective slit-like gas jet orifices that are each wider than the steel strip in a transverse direction of the steel strip, and configured to spray gas from the respective gas jet orifices onto the steel strip to adjust a coating weight on both sides of the steel strip; and a pair of baffle plates respectively arranged outside of both transverse edges of the steel strip in a state in which both sides of each of the pair of baffle plates partially face the respective gas jet orifices of the pair of gas wiping nozzles, wherein a height B of a lower end of each of the pair of baffle plates with respect to a bath surface of the molten metal bath is +50 mm or less, where an upper side in a vertical direction is positive.

[6] The continuous hot-dip metal coating line according to [5], wherein the height B is −10 mm or more.

[7] The continuous hot-dip metal coating line according to [5] or [6], wherein the pair of gas wiping nozzles are each placed to point downward with respect to a horizontal plane so that an angle θ between the gas jet orifice and the horizontal plane is 10° or more and 75° or less.

Advantageous Effect

It is possible to provide a method of producing a hot-dip metal coated steel strip and a continuous hot-dip metal coating line that can produce a hot-dip metal coated steel strip of high quality by sufficiently suppressing edge overcoating.

BRIEF DESCRIPTION OF THE DRAWINGS

In the accompanying drawings:

FIG. 6 is an enlarged view of a transverse edge of the steel strip in

FIG. 5 and its surroundings;

DETAILED DESCRIPTION

A method of producing a hot-dip metal coated steel strip and a continuous hot-dip metal coating line (hereafter also simply referred to as "coating line") 100 according to one of the disclosed embodiments will be described below, with reference to FIG. 1.

Figure 1:
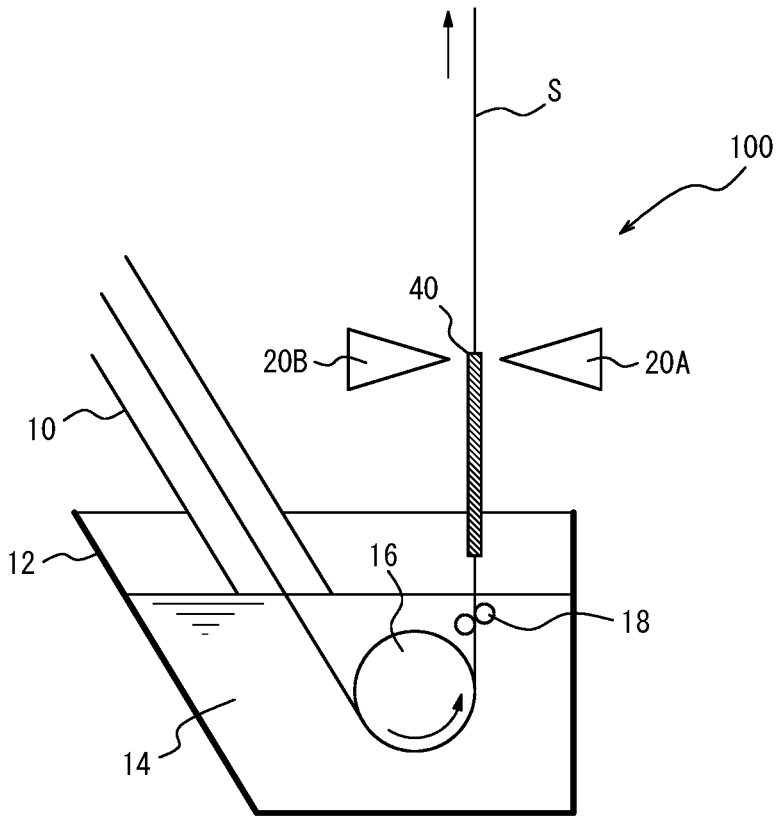
FIG. 1 is a schematic view illustrating a structure of a continuous hot-dip metal coating line 100 according to one of the disclosed embodiments.

With reference to FIG. 1, the coating line 100 according to this embodiment includes a snout 10, a coating tank 12 that contains molten metal, a sink roll 16, and support rolls 18. The snout 10 is a member that defines the space through which a steel strip S passes, and has a rectangular section perpendicular to the steel strip traveling direction. The snout 10 has a tip immersed in a molten metal bath 14 formed in the coating tank 12. In this embodiment, the steel strip S annealed in a continuous annealing furnace with a reducing atmosphere passes through the snout 10, and is continuously introduced into the molten metal bath 14 in the coating tank 12. The steel strip S is then pulled upward from the molten metal bath 14 through the sink roll 16 and the support rolls 18 in the molten metal bath 14, and adjusted to have a predetermined coating thickness by a pair of gas wiping nozzles 20A and 20B. After this, the steel strip S is cooled, and guided to subsequent steps.

Figure 2:
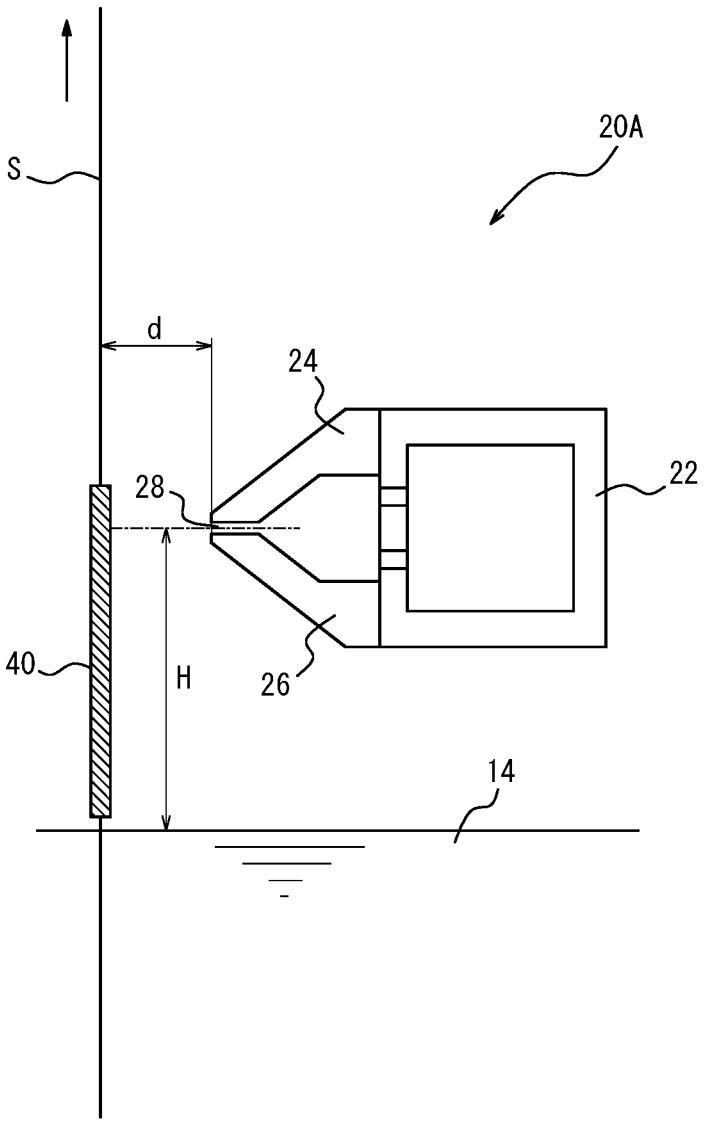
FIG. 2 is a sectional view, perpendicular to a steel strip S, of a gas wiping nozzle 20A according to one of the disclosed embodiments.

The pair of gas wiping nozzles (hereafter also simply referred to as "nozzles") 20A and 20B face each other with the steel strip S therebetween, above the coating tank 12. With reference to FIG. 2 in addition to FIG. 1, the nozzle 20A sprays gas onto the steel strip S from a slit-like gas jet orifice 28 extending in the sheet transverse direction of the steel strip at its tip, to adjust the coating weight on the steel strip surface. The other nozzle 20B operates in the same way. By the pair of nozzles 20A and 20B, excess molten metal is wiped away to adjust the coating weight on both sides of the steel strip S and also uniformize the coating weight in the sheet transverse direction and the sheet longitudinal direction.

Figure 5:
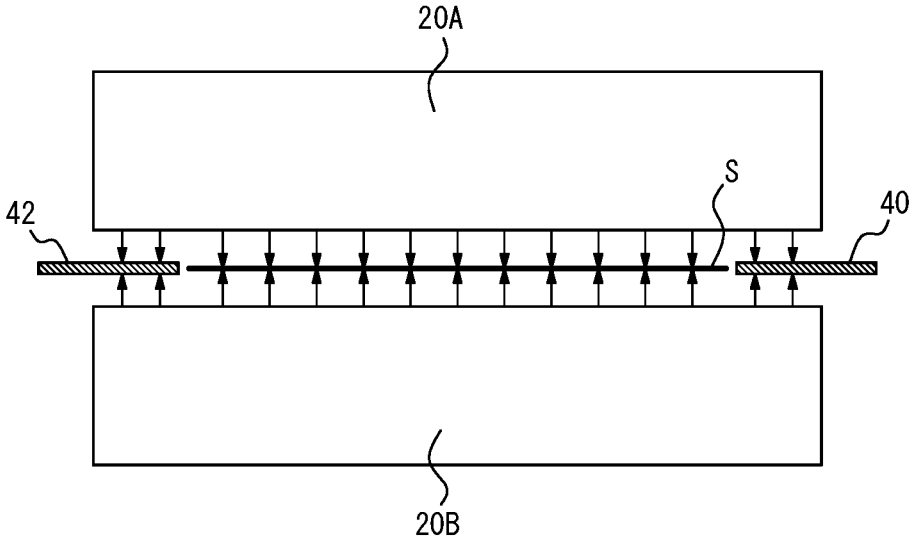
FIG. 5 is a top view of gas wiping nozzles 20A and 20B in FIG. 1 and their surroundings.

As illustrated in FIG. 5, the nozzles 20A and 20B are each typically made wider than the steel strip width to accommodate various steel strip widths and also cope with, for example, a displacement of the steel strip in the transverse direction when pulling the steel strip up. The nozzles 20A and 20B thus each extend outward beyond the transverse edges of the steel strip. That is, the slit-like gas jet orifice 28 of each of the nozzles 20A and 20B is wider than the steel strip in the transverse direction of the steel strip.

As illustrated in FIG. 2, the nozzle 20A includes a nozzle header 22 and an upper nozzle member 24 and a lower nozzle member 26 connected to the nozzle header 22. The respective tip portions of the upper and lower nozzle members 24 and 26 have surfaces facing each other in parallel in a sectional view perpendicular to the steel strip S, and thus form the slit-like gas jet orifice 28. The gas jet orifice 28 extends in the sheet transverse direction of the steel strip S. The nozzle 20A has a longitudinal section that tapers down toward the tip. The thickness of the tip portion of each of the upper and lower nozzle members 24 and 26 may be about 1 mm to 3 mm. The opening width (nozzle gap) of the gas jet orifice is not limited, and may be about 0.5 mm to 3.0 mm. Gas supplied from a gas supply mechanism (not illustrated) passes through the inside of the header 22 and further passes through the gas passage defined by the upper and lower nozzle members 24 and 26, and is ejected from the gas jet orifice 28 and sprayed onto the surface of the steel strip S. The other nozzle 20B has the same structure. In the present disclosure, the pressure of the gas inside the nozzle header 22 is referred to as "header pressure P".

In the method of producing a hot-dip metal coated steel strip according to this embodiment, the steel strip S is continuously immersed into the molten metal bath 14, and gas is sprayed onto the steel strip S while being pulled up from the molten metal bath 14 from the pair of gas wiping nozzles 20A and 20B arranged so that the steel strip S is situated therebetween to adjust the coating weight of the molten metal on both sides of the steel strip S, thus continuously producing a hot-dip metal coated steel strip.

Figure 4:
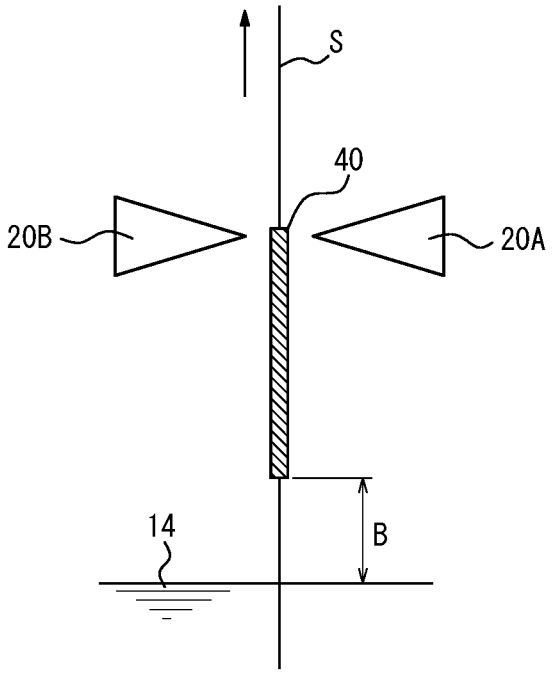
FIG. 4 is an enlarged view of a baffle plate 40 in FIG. 1 and its surroundings.
Figure 6:
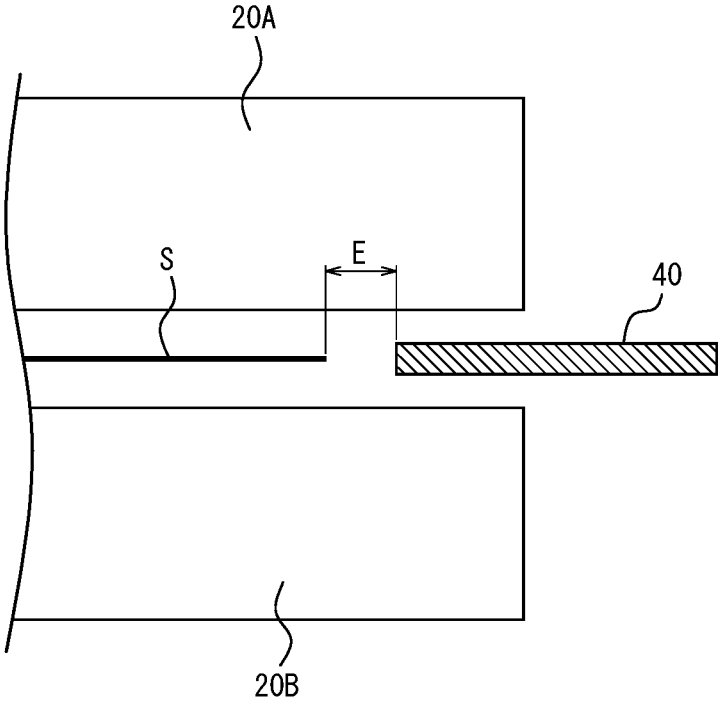

With reference to FIGS. 4 to 6 in addition to FIGS. 1 and 2, in this embodiment, a pair of baffle plates 40 and 42 are located outside of both transverse edges of the steel strip S, and preferably located near the transverse edges of the steel strip S and in a plane extended from the steel strip S. The baffle plates 40 and 42 are located between the pair of nozzles 20A and 20B. Therefore, both sides of each baffle plate face the gas jet orifices 28 of the pair of nozzles 20A and 20B. The baffle plates 40 and 42 prevent the gas sprayed from the pair of nozzles 20A and 20B from directly colliding with each other, thus contributing to reduced splashing.

Figure 7:
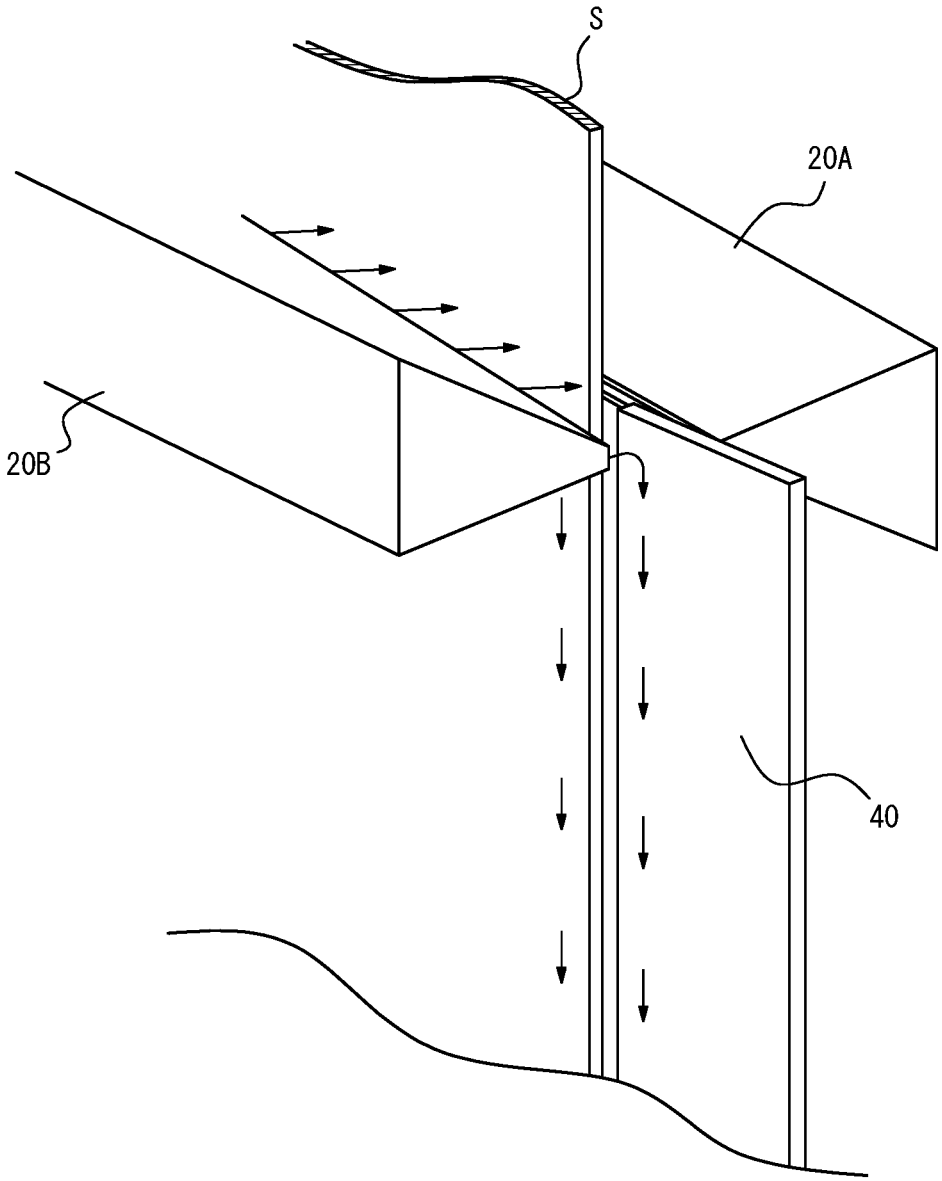
FIG. 7 is a perspective view of the baffle plate 40 in FIG. 1 and its surroundings.

The shape of each of the baffle plates 40 and 42 is not limited, but is preferably rectangular as illustrated in FIG. 7. Two sides of the rectangular shape of the baffle plate are preferably in parallel with the extending direction of the transverse edge of the steel strip S. The thickness of each of the baffle plates 40 and 42 is desirably 2 mm to 10 mm. If the thickness is 2 mm or more, the baffle plate does not deform easily by the pressure of the wiping gas. If the thickness is 10 mm or less, the baffle plate is unlikely to come into contact with the wiping nozzle or undergo thermal deformation.

Figure 8:
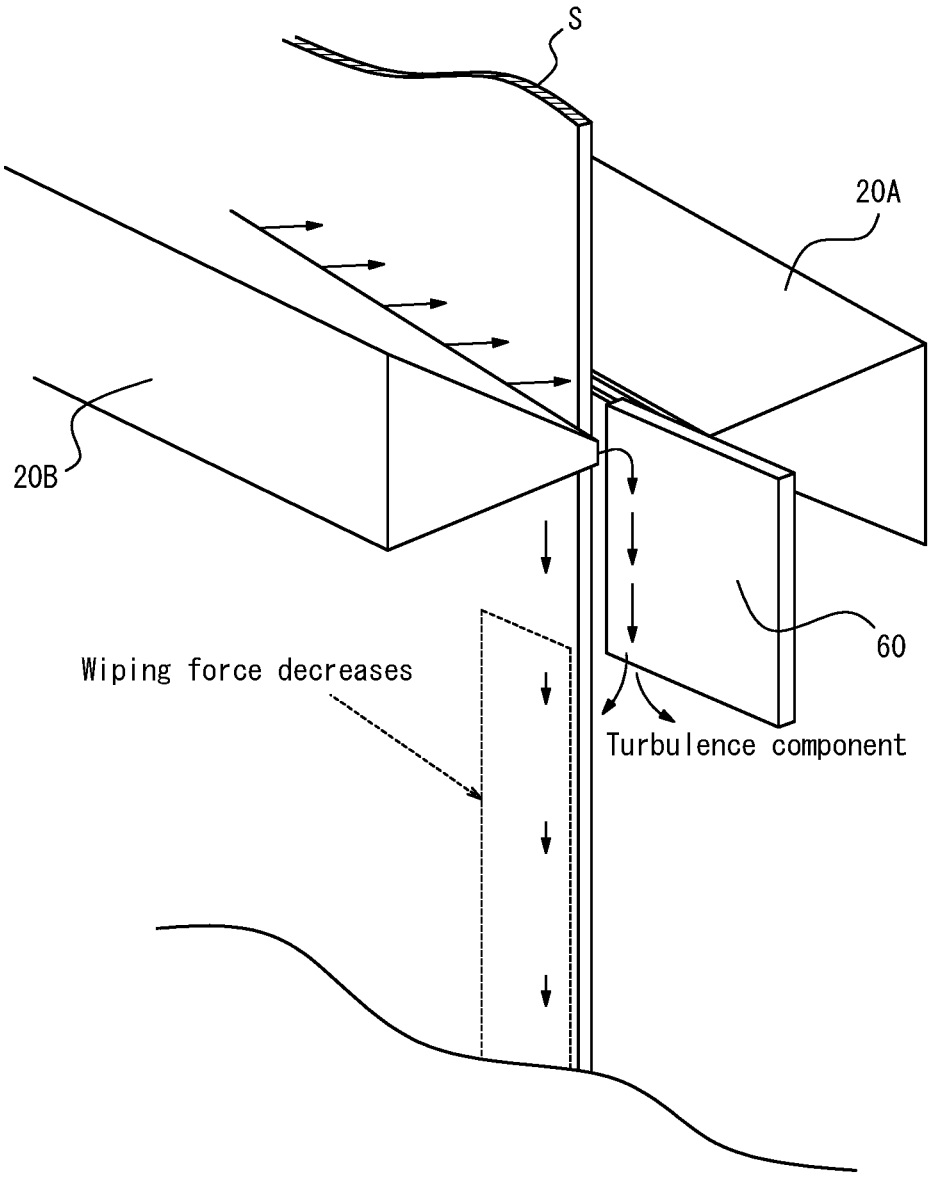
FIG. 8 is a perspective view of a baffle plate 60 and its surroundings according to a conventional technique.

With reference to FIG. 4, it is important in this embodiment to limit the height B of the lower end of each of the pair of baffle plates 40 and 42 with respect to the bath surface of the molten metal bath 14 to +50 mm or less, where the upper side in the vertical direction is positive. If the height B is more than +50 mm, the vertical length of the edge portion of the steel strip surface in which the wiping force decreases due to the turbulence that occurs directly below the lower end of the baffle plate is more than 50 mm, as illustrated in FIG. 8. In such a case, the molten metal that has remained and become massive in the edge portion causes edge overcoating, as mentioned above. By limiting the height B to +50 mm or less, the vertical length of the edge portion of the steel strip surface in which the wiping force decreases can be reduced to 50 mm or less. Consequently, edge overcoating can be suppressed sufficiently. From the viewpoint of suppressing edge overcoating more sufficiently, the height B is preferably +40 mm or less, and more preferably +30 mm or less. Most preferably, the baffle plates 40 and 42 are immersed in the molten metal bath, that is, B=0 mm or B<0 mm.

Particularly under high coating weight and low gas pressure conditions of a target coating thickness of 120 g/m$^2$ or more and a header pressure P of 30 kPa or less, the edge portion of the steel strip surface tends to lift top dross (a mass of zinc floating on the pot bath surface), so that edge overcoating tends to worsen. The effect of suppressing edge overcoating according to the present disclosure is particularly remarkable under such conditions. Here, the header pressure P is preferably 1 kPa or more.

The height B is preferably −10 mm or more. This can reduce the possibility that the baffle plates come into contact with the support rolls 18 in the molten metal bath or the baffle plates hinder flow of dross in the bath and increase dross defects.

In an operation example, the height of the bath surface slightly changes during operation. Specifically, as a result of the steel strip taking the molten zinc out, the height of the bath surface decreases gradually. Once the height of the bath surface has decreased by approximately several mm, an ingot of the bath composition is gradually added during operation to restore the original bath surface height. The bath surface height can be constantly monitored by a laser displacement meter. Since the method of producing a hot-dip metal coated steel strip according to this embodiment achieves the effect of suppressing edge overcoating by performing wiping in a state in which the height B is +50 mm or less, it is preferable to constantly maintain the state in which the height B is +50 mm or less during operation, but the present disclosure is not limited to such and includes cases where the height B temporarily exceeds +50 mm during operation. It is to be noted that the continuous hot-dip metal coating line according to this embodiment is configured to perform control so as to constantly maintain the state in which the height B is +50 mm or less during operation.

The height of the upper end of each of the baffle plates 40 and 42 is not limited, as long as it is higher than the position of the gas jet orifice 28. From the viewpoint of reliably preventing direct collision of the gas, the height of the upper end of each of the baffle plates 40 and 42 is preferably 10 mm or more higher than the gap center position of the gas jet orifice 28. From the viewpoint of avoiding providing the baffle plates in unnecessary areas, the height of the upper end of each of the baffle plates 40 and 42 is preferably 300 mm or less higher than the gap center position of the gas jet orifice 28.

With reference to FIG. 6, the distance E between the transverse edge of the steel strip and the baffle plate is preferably 10 mm or less, and more preferably 5 mm or less.

Thus, direct collision of facing jets can be prevented more reliably. From the viewpoint of reducing the possibility that the steel strip comes into contact with the baffle plate when meandering, the distance E is preferably 3 mm or more.

The material of the baffle plates is not limited. In this embodiment, since the baffle plates are close to the bath surface, top dross or splashes (splashes of molten zinc) may adhere to the baffle plates and alloy with the baffle plates and stick thereto. Moreover, in the case where the baffle plates are immersed in the bath, not only the foregoing alloying but also thermal deformation needs to be taken into consideration. From this viewpoint, examples of the material of the baffle plates include iron plates to which a boron nitride-based spray repellent to zinc has been applied, and SUS316L that is hard to react with zinc. Further, ceramic such as alumina, silicon nitride, or silicon carbide is desirable because both alloying and thermal deformation can be suppressed.

With reference to FIG. 2, the nozzle height H is desirably low. When the nozzle height H is low, the molten metal at the stagnation point is high in temperature and low in viscosity, so that wiping can be performed with low header pressure and edge overcoating is unlikely to occur. Moreover, the length of each baffle plate can be reduced, with it being possible to maintain the rigidity of the baffle plate. If the nozzle height is excessively low, however, splashing occurs in large amount at high gas pressure. The nozzle height H therefore needs to be adjusted to an appropriate height. From this viewpoint, the nozzle height H is preferably 50 mm or more and more preferably 80 mm or more, and is preferably 450 mm or less and more preferably 250 mm or less.

Figure 3:
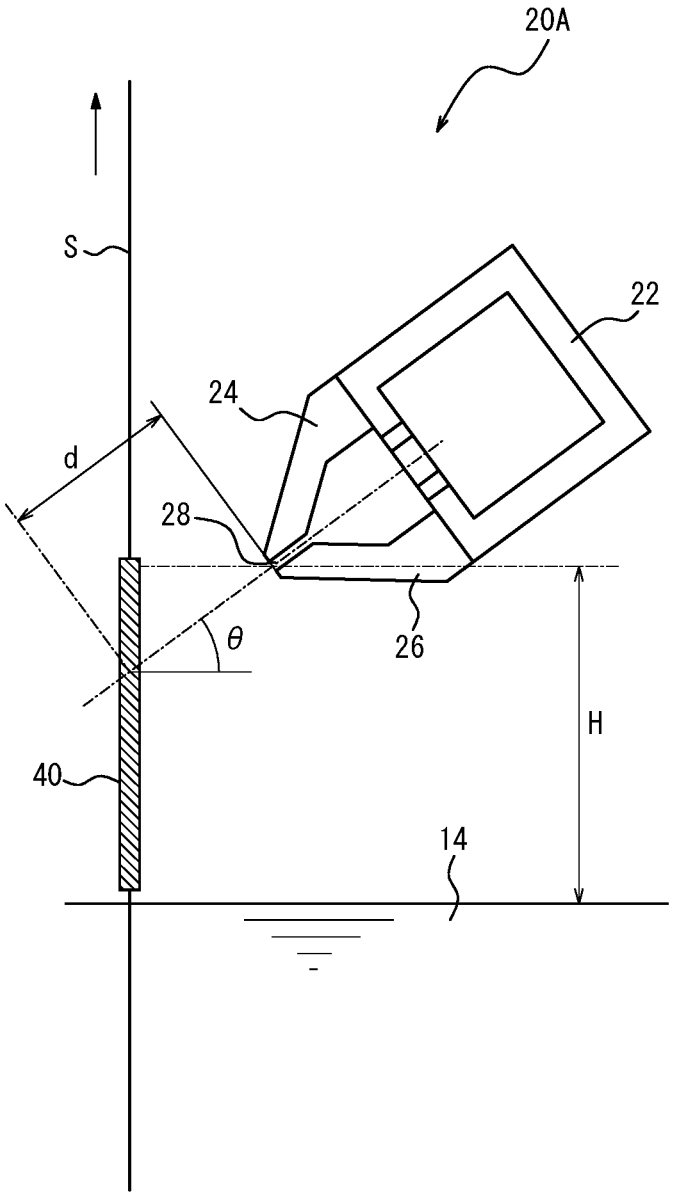
FIG. 3 is a sectional view, perpendicular to the steel strip S, of the gas wiping nozzle 20A in a state in which the nozzle angle θ is more than 0° according to one of the disclosed embodiments.

With reference to FIG. 3, in this embodiment, it is preferable to place each of the pair of gas wiping nozzles 20A and 20B to point downward with respect to a horizontal plane so that the angle θ between the gas jet orifice 28 and the horizontal plane is 10° or more and 75° or less. Herein, the "angle θ between the gas jet orifice and the horizontal plane" denotes the angle between the extending direction of a parallel portion (i.e. the part where the upper nozzle member 24 and the lower nozzle member 26 face each other and form a slit) and the horizontal plane in a sectional view perpendicular to the steel strip, as illustrated in FIG. 3. By limiting the nozzle angle θ to 10° or more, the shear force by the wiping gas can be enhanced. Hence, a phenomenon in which the wiping force decreases can be further prevented, and a remarkable edge overcoating suppression effect can be achieved. If the nozzle angle θ is more than 75°, there is a possibility that unstable pressure accumulation occurs and a wavy flow pattern called bath wrinklesoccurs on the coating surface. Therefore, the nozzle angle θ is preferably 75° or less.

With reference to FIGS. 2 and 3, the distance d between the nozzle tip and the steel strip is not limited. From the viewpoint of reducing the possibility of the nozzle tip coming into contact with the steel strip, the distance d is preferably 3 mm or more. From the viewpoint of saving the wiping gas, the distance d is preferably 50 mm or less.

The gas sprayed from the gas wiping nozzle is not limited, and may be, for example, air. The gas may be inert gas. By using inert gas, oxidation of the molten metal on the steel strip surface can be prevented, so that viscosity unevenness of the molten metal can be further suppressed. The inert gas may contain, but is not limited to, one or more selected from the group consisting of nitrogen, argon, helium, and carbon dioxide.

In this embodiment, the chemical composition of the molten metal preferably contains Al: 1.0 mass % to 10 mass %, Mg: 0.2 mass % to 1 mass %, and Ni: 0 mas s% to 0.1 mass %, with the balance being Zn and inevitable impurities. It has been recognized that the molten metal having such Mg content is easily oxidizable and the amount of top dross increases, and as a result edge overcoating tends to occur. Hence, in the case where the molten metal has the foregoing chemical composition, the effect of suppressing edge overcoating according to the present disclosure is remarkable. In the case where the chemical composition of the molten metal is 5 mass % Al—Zn and in the case where the chemical composition of the molten metal is 55 mass % Al—Zn, too, the effect of suppressing edge overcoating according to the present disclosure can be achieved.

A hot-dip metal coated steel strip produced by the production method and the coating line according to the present disclosure is, for example, a hot-dip galvanized steel sheet. Examples of the hot-dip galvanized steel sheet include a galvanized steel sheet (GI) obtained without alloying treatment after hot-dip galvanizing treatment and a galvannealed steel sheet (GA) obtained by performing alloying treatment after hot-dip galvanizing treatment.

EXAMPLES

Example 1

A hot-dip galvanized steel strip production test was conducted in a hot-dip galvanized steel strip production line. The coating line illustrated in FIG. 1 was used in each of Examples and Comparative Examples. Gas wiping nozzles with a nozzle gap of 1.2 mm were used. In each of Examples and Comparative Examples, the composition of the molten bath, the height B of the lower end of each baffle plate with respect to the bath surface, the nozzle angle θ, the wiping gas pressure (header pressure) P, the distance d between the nozzle tip and the steel strip, and the steel strip speed L are indicated in Table 1. The upper end of the baffle plate was 70 mm higher than the gap center position of the gas jet orifice. The nozzle height H from the bath surface was 200 mm. The material of the baffle plate was silicon nitride, the thickness of the baffle plate was 3 mm, and the distance E between the transverse edge of the steel strip and the baffle plate was 5 mm.

As a method of supplying gas to each gas wiping nozzle, a method of supplying, to the nozzle header, gas pressurized to a predetermined pressure by a compressor was employed. The gas type was air, and the wiping gas temperature was 100 ° C. A steel strip with a thickness of 1.2 mm and a width of 1000 mm was passed through the line at a predetermined steel strip speed L to produce a hot-dip galvanized steel strip.

The edge overcoating ratio R on both sides of the produced hot-dip galvanized steel strip was measured and evaluated according to the following procedure. The total target coating weight CW ($g/m^2$) on both sides for each sample is indicated in Table 1. For the galvanized steel strip produced for each sample, the total actual coating weight CWc ($g/m^2$) on both sides in a steel sheet center portion and the total actual coating weight CWe ($g/m^2$) on both sides in a steel sheet edge portion were measured. The results are indicated in Table 1. The measurement of each of CWc and CWe was performed on one part of each of both sides in accordance with JIS G3302. The edge overcoating ratio R was calculated as $(CWe/CWc-1)\times 100$ (%). The results are indicated in Table 1. Table 1 also indicates, for each coating type, the edge overcoating improving ratio relative to the edge overcoating ratio in the case where no baffle plates were used. For coating type B, the edge overcoating improving ratio in each of Nos. 9 to 13 and 18 to 23 is relative to No. 8, and the edge overcoating improving ratio in each of Nos. 15 to 17 is relative to No. 14. Each sample having an edge overcoating improving ratio of 50% or more was evaluated as pass, and each sample having an edge overcoating improving ratio of less than 50% was evaluated as fail.

| No. | Catagory | Coating type | Molten bath composition [%] Al | Mg | Ni | Si | Zn | Height B of lower end of baffle plate with respect to bath surface [mm] | Nozzle angle θ [°] | Gas pressure P [kPa] | Distanced between nozzle tip and steel strip [mm] | Steel strip speed L [m/min] | Target coating weight CW [g/m$^2$] | Actual coating weight CWc in steel sheet center portion [g/m$^2$] | Actual coating weight CWe in steel sheet edge portion [g/m$^2$] | Edge overcoating ratio R [%] | Edge overcoating improving ratio [%] |
|---|---|---|---|---|---|---|---|---|---|---|---|---|---|---|---|---|---|
| 1 | Comparative Example | A | 0.2 | 0 | 0 | 0 | Balance | No baffle plates | 0 | 25 | 13 | 90 | 120 | 118 | 182 | 54 | — |
| 2 | Comparative Example | | | | | | | 200 | 0 | 25 | 13 | 90 | 120 | 120 | 162 | 35 | 35 |
| 3 | Comparative Example | | | | | | | 70 | 0 | 25 | 13 | 90 | 120 | 121 | 158 | 31 | 44 |
| 4 | Example | | | | | | | 50 | 0 | 25 | 13 | 90 | 120 | 122 | 142 | 16 | 70 |
| 5 | Example | | | | | | | 25 | 0 | 25 | 13 | 90 | 120 | 119 | 135 | 13 | 75 |
| 6 | Example | | | | | | | 0 | 0 | 25 | 13 | 90 | 120 | 120 | 132 | 10 | 82 |
| 7 | Example | | | | | | | 0 | 30 | 28 | 13 | 90 | 120 | 120 | 124 | 3 | 94 |
| 8 | Comparative Example | B | 4.5 | 0.5 | 0.05 | 0 | Balance | No baffle plates | 0 | 5.5 | 17 | 55 | 270 | 272 | 561 | 106 | — |
| 9 | Comparative Example | | | | | | | 200 | 0 | 5.5 | 17 | 50 | 270 | 270 | 493 | 83 | 22 |
| 10 | Comparative Example | | | | | | | 70 | 0 | 5.5 | 17 | 50 | 270 | 270 | 487 | 80 | 24 |
| 11 | Example | | | | | | | 50 | 0 | 5.5 | 17 | 50 | 270 | 271 | 384 | 42 | 61 |
| 12 | Example | | | | | | | 25 | 0 | 5.5 | 17 | 50 | 270 | 270 | 350 | 30 | 72 |
| 13 | Example | | | | | | | 0 | 0 | 5.5 | 17 | 50 | 270 | 268 | 316 | 18 | 83 |
| 14 | Comparative Example | | | | | | | No baffle plates | 0 | 22 | 13 | 90 | 120 | 123 | 220 | 79 | — |
| 15 | Example | | | | | | | 50 | 0 | 22 | 13 | 90 | 120 | 120 | 144 | 20 | 75 |
| 16 | Example | | | | | | | 25 | 0 | 22 | 13 | 90 | 120 | 121 | 140 | 16 | 80 |
| 17 | Example | | | | | | | 0 | 0 | 22 | 13 | 90 | 120 | 120 | 131 | 9 | 88 |
| 18 | Example | | | | | | | 0 | 10 | 5.5 | 17 | 50 | 275 | 274 | 315 | 15 | 86 |
| 19 | Example | | | | | | | 0 | 15 | 5.5 | 17 | 50 | 280 | 279 | 307 | 10 | 91 |
| 20 | Example | | | | | | | 0 | 30 | 5.5 | 17 | 50 | 290 | 292 | 318 | 9 | 92 |
| 21 | Example | | | | | | | 0 | 50 | 5.5 | 17 | 50 | 310 | 310 | 342 | 10 | 90 |
| 22 | Example | | | | | | | 0 | 75 | 5.5 | 17 | 50 | 320 | 322 | 359 | 11 | 89 |
| 23 | Example | | | | | | | 0 | 30 | 8 | 17 | 50 | 270 | 270 | 284 | 5 | 95 |
| 24 | Comparative Example | C | 5 | 0 | 0 | 0 | Balance | No baffle plates | 0 | 14 | 14 | 80 | 180 | 180 | 309 | 72 | — |
| 25 | Comparative Example | | | | | | | 200 | 0 | 14 | 14 | 80 | 180 | 179 | 272 | 52 | 28 |
| 26 | Comparative Example | | | | | | | 70 | 0 | 14 | 14 | 80 | 180 | 178 | 266 | 49 | 31 |
| 27 | Example | | | | | | | 50 | 0 | 14 | 14 | 80 | 180 | 178 | 226 | 27 | 62 |
| 28 | Example | | | | | | | 25 | 0 | 14 | 14 | 80 | 180 | 180 | 216 | 20 | 72 |
| 29 | Example | | | | | | | 0 | 0 | 14 | 14 | 80 | 180 | 181 | 207 | 14 | 80 |
| 30 | Example | | | | | | | 0 | 30 | 16 | 14 | 80 | 180 | 180 | 185 | 3 | 96 |
| 31 | Comparative Example | D | 55 | 0 | 0 | 1.6 | Balance | No bafifle plates | 0 | 8 | 14 | 70 | 200 | 203 | 323 | 59 | — |
| 32 | Comparative Example | | | | | | | 200 | 0 | 8 | 14 | 70 | 200 | 201 | 287 | 43 | 28 |
| 33 | Comparative Example | | | | | | | 70 | 0 | 8 | 14 | 70 | 200 | 198 | 280 | 41 | 30 |
| 34 | Example | | | | | | | 50 | 0 | 8 | 14 | 70 | 200 | 198 | 247 | 25 | 58 |
| 35 | Example | | | | | | | 25 | 0 | 8 | 14 | 70 | 200 | 200 | 236 | 18 | 70 |
| 36 | Example | | | | | | | 0 | 0 | 8 | 14 | 70 | 200 | 199 | 221 | 11 | 81 |
| 37 | Example | | | | | | | 0 | 30 | 10 | 14 | 70 | 200 | 199 | 206 | 4 | 94 |
| 38 | Comparative Example | E | 5 | 0.9 | 0 | 0 | Balance | No bafifle plates | 0 | 6 | 16 | 60 | 240 | 240 | 467 | 95 | — |
| 39 | Comparative Example | | | | | | | 200 | 0 | 6 | 16 | 60 | 240 | 241 | 404 | 68 | 28 |
| 40 | Comparative Example | | | | | | | 70 | 0 | 6 | 16 | 60 | 240 | 238 | 392 | 65 | 32 |
| 41 | Example | | | | | | | 50 | 0 | 6 | 16 | 60 | 240 | 239 | 306 | 28 | 70 |

-continued

| No. | Catagory | Coating type | Molten bath composition [%] Al | Mg | Ni | Si | Zn | Height B of lower end of baffle plate with respect to bath surface [mm] | Nozzle angle θ [°] | Gas pressure P [kPa] | Distanced between nozzle tip and steel strip [mm] | Steel strip speed L [m/min] | Target coating weight CW [g/m$^2$] | Actual coating weight CWc in steel sheet center portion [g/m$^2$] | Actual coating weight CWe in steel sheet edge portion [g/m$^2$] | Edge overcoating ratio R [%] | Edge overcoating improving ratio [%] |
|---|---|---|---|---|---|---|---|---|---|---|---|---|---|---|---|---|---|
| 42 | Example | | | | | | | 25 | 0 | 6 | 16 | 60 | 240 | 240 | 292 | 22 | 77 |
| 43 | Example | | | | | | | 0 | 0 | 6 | 16 | 60 | 240 | 241 | 278 | 15 | 84 |
| 44 | Example | | | | | | | 0 | 30 | 9 | 16 | 60 | 240 | 239 | 269 | 13 | 87 |
| 45 | Comparative Example | F | 4.9 | 0.6 | 0.09 | 0 | Balance | No baffle plates | 0 | 4.5 | 25 | 45 | 350 | 350 | 668 | 91 | — |
| 46 | Comparative Example | | | | | | | 200 | 0 | 4.5 | 25 | 45 | 350 | 347 | 603 | 74 | 19 |
| 47 | Comparative Example | | | | | | | 70 | 0 | 4.5 | 25 | 45 | 350 | 348 | 588 | 69 | 24 |
| 48 | Example | | | | | | | 50 | 0 | 4.5 | 25 | 45 | 350 | 352 | 453 | 29 | 68 |
| 49 | Example | | | | | | | 25 | 0 | 4.5 | 25 | 45 | 350 | 348 | 412 | 18 | 80 |
| 50 | Example | | | | | | | 0 | 0 | 4.5 | 25 | 45 | 350 | 351 | 401 | 14 | 84 |
| 51 | Example | | | | | | | 0 | 30 | 8 | 25 | 45 | 350 | 350 | 366 | 5 | 95 |

As is clear from Table 1, in the case where the height B of the lower end of the baffle plate with respect to the bath surface was 50 mm or less, the edge overcoating ratio R was low and the edge overcoating improving ratio was 50% or more, and a coated steel sheet of good quality was able to be produced. In the case where the height B of the lower end of the baffle plate with respect to the bath surface was outside the range according to the present disclosure, on the other hand, the edge overcoating ratio R was high and the edge overcoating improving ratio was less than 50%. Particularly in coating types B, E, and F, the effect in the case of limiting the height B of the lower end of the baffle plate with respect to the bath surface to be within the range according to the present disclosure was remarkable.

Example 2

A hot-dip galvanized steel strip production test was conducted using the coating line illustrated in FIG. 1, while varying the height B of the lower end of each baffle plate with respect to the bath surface.

Gas wiping nozzles with a nozzle gap of 1.2 mm were used. The composition of the molten bath contained Al: 0.2 mass %, with the balance being zinc. The nozzle angle θ was 0°, the wiping gas pressure (header pressure) P was 8 kPa, the distance d between the nozzle tip and the steel strip was 10 mm, and the steel strip speed L was 50 m/min. The upper end of the baffle plate was 70 mm higher than the gap center position of the gas jet orifice. The nozzle height H from the bath surface was 200 mm. The material of the baffle plate was silicon nitride, the thickness of the baffle plate was 3 mm, and the distance E between the transverse edge of the steel strip and the baffle plate was 5 mm.

Figure 9:
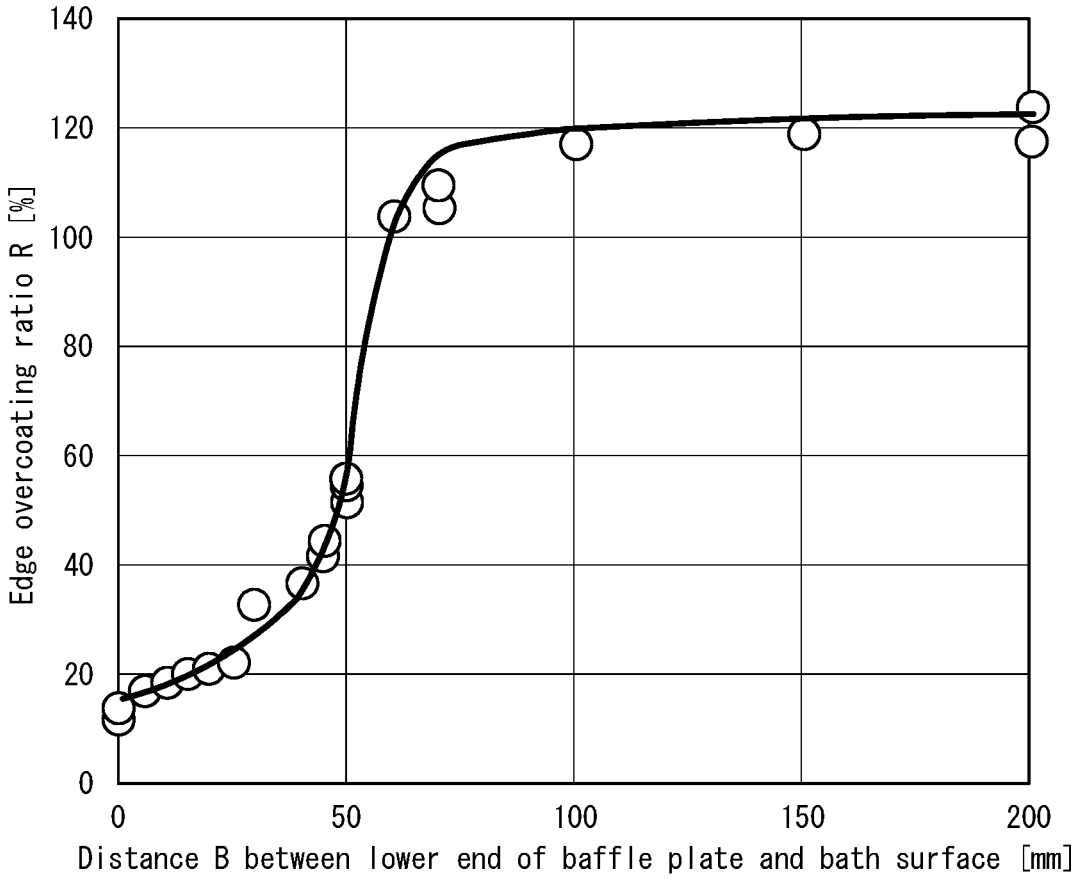
FIG. 9 is a graph illustrating the relationship between the height B of the lower end of the baffle plate with respect to the bath surface and the edge overcoating ratio R.
Figure 10:
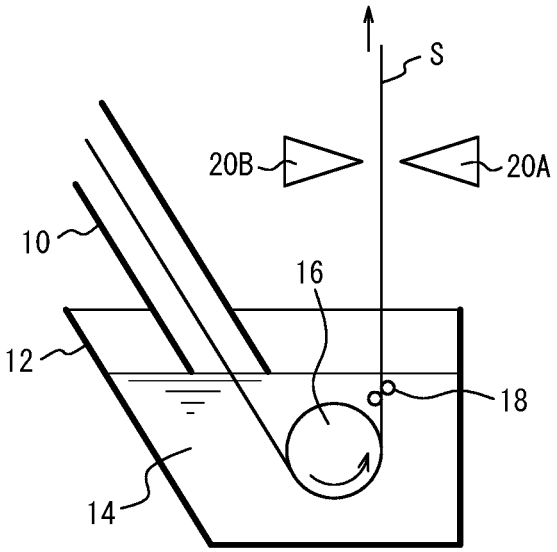
FIG. 10 is a schematic view illustrating a structure of a typical continuous hot-dip metal coating line.

The edge overcoating ratio R was measured in the same way as in Example 1. FIG. 9 illustrates the relationship between the edge overcoating ratio R and the height B of the lower end of the baffle plate with respect to the bath surface. Moreover, the edge portion of the steel strip surface was observed with a camera, to determine the state of the molten metal in the edge portion.

As is clear from FIG. 9, the edge overcoating ratio R was high in the case where the height B of the lower end of the baffle plate was 60 mm or more, but significantly decreased in the case where the height B of the lower end of the baffle plate was 50 mm or less. Moreover, in the case where the height B of the lower end of the baffle plate was 60 mm or more, the molten metal that had remained and become massive in the edge portion was observed. In the case where the height B of the lower end of the baffle plate was 50 mm or less, such massive molten metal was not observed, and the surface state of the molten metal was relatively uniform.

INDUSTRIAL APPLICABILITY

It is possible to provide a method of producing a hot-dip metal coated steel strip and a continuous hot-dip metal coating line that can produce a hot-dip metal coated steel strip of high quality by sufficiently suppressing edge overcoating.

REFERENCE SIGNS LIST

100 continuous hot-dip metal coating line
10 snout
12 coating tank
14 molten metal bath
16 sink roll
18 support roll
20A gas wiping nozzle
20B gas wiping nozzle
22 nozzle header
24 upper nozzle member
26 lower nozzle member
28 gas jet orifice
40 baffle plate
42 baffle plate
S steel strip
B height of lower end of baffle plate with respect to bath surface
θ angle between gas jet orifice and horizontal plane
d distance between nozzle tip and steel strip
H nozzle height
E distance between transverse edge of steel strip and baffle plate

The invention claimed is:

1. A method of producing a hot-dip metal coated steel strip, the method comprising:

continuously immersing a steel strip into a molten metal bath; and spraying, onto the steel strip while being pulled up from the molten metal bath, gas from respective slit-like gas jet orifices of a pair of gas wiping nozzles arranged so that the steel strip is situated therebetween, to adjust a coating weight of molten metal on both sides of the steel strip to thereby continuously produce a hot-dip metal coated steel strip, the gas jet orifices each being wider than the steel strip in a transverse direction of the steel strip, wherein a pair of baffle plates are respectively placed outside of both transverse edges of the steel strip in a state in which both sides of each of the pair of baffle plates partially face the respective gas jet orifices of the pair of gas wiping nozzles, and a height B of a lower end of each of the pair of baffle plates with respect to a bath surface of the molten metal bath is set to +50 mm or less, where an upper side in a vertical direction with respect to the bath surface is positive.

2. The method of producing a hot-dip metal coated steel strip according to claim 1, wherein the height B is set to −10 mm or more.

3. The method of producing a hot-dip metal coated steel strip according to claim 2, wherein the pair of gas wiping nozzles are each placed to point downward with respect to a horizontal plane so that an angle θ between the gas jet orifice and the horizontal plane is 10° or more and 75° or less.

4. The method of producing a hot-dip metal coated steel strip according to claim 3, wherein a chemical composition of the molten metal contains Al: 1.0 mass % to 10 mass %, Mg: 0.2 mass % to 1 mass %, and Ni: 0 mass % to 0.1 mass %, with a balance being Zn and inevitable impurities.

5. The method of producing a hot-dip metal coated steel strip according to claim 2, wherein a chemical composition of the molten metal contains Al: 1.0 mass % to 10 mass %, Mg: 0.2 mass % to 1 mass %, and Ni: 0 mass % to 0.1 mass %, with a balance being Zn and inevitable impurities.

6. The method of producing a hot-dip metal coated steel strip according to claim 1, wherein the pair of gas wiping nozzles are each placed to point downward with respect to a horizontal plane so that an angle θ between the gas jet orifice and the horizontal plane is 10° or more and 75° or less.

7. The method of producing a hot-dip metal coated steel strip according to claim 6, wherein a chemical composition of the molten metal contains Al: 1.0 mass % to 10 mass %, Mg: 0.2 mass % to 1 mass %, and Ni: 0 mass % to 0.1 mass %, with a balance being Zn and inevitable impurities.

8. The method of producing a hot-dip metal coated steel strip according to claim 1, wherein a chemical composition of the molten metal contains Al: 1.0 mass % to 10 mass %, Mg: 0.2 mass % to 1 mass %, and Ni: 0 mass % to 0.1 mass %, with a balance being Zn and inevitable impurities.

* * * * *